US011839292B1

(12) United States Patent
Xiang et al.

(10) Patent No.: US 11,839,292 B1
(45) Date of Patent: Dec. 12, 2023

(54) EASILY-ASSEMBLED DESK FOOT AND A HEIGHT-ADJUSTABLE DESK

(71) Applicant: FLEXISPOT, INC.

(72) Inventors: Lehong Xiang, Ningbo (CN); Fangyuan Li, Ningbo (CN); Yibin Feng, Ningbo (CN)

(73) Assignee: FLEXISPOT, INC., Livermore, CA (US)

( * ) Notice: Subject to any disclaimer, the term of this patent is extended or adjusted under 35 U.S.C. 154(b) by 0 days.

(21) Appl. No.: 17/820,602

(22) Filed: Aug. 18, 2022

(30) Foreign Application Priority Data

Jun. 27, 2022 (CN) ..... 202221624982.8

(51) Int. Cl.
*A47B 13/02* (2006.01)
*A47B 9/00* (2006.01)
*A47B 91/00* (2006.01)

(52) U.S. Cl.
CPC ..... *A47B 13/02* (2013.01); *A47B 9/00* (2013.01); *A47B 91/005* (2013.01)

(58) Field of Classification Search
CPC ..... A47B 13/02; A47B 13/021; A47B 9/00; A47B 91/005; A47B 91/00
See application file for complete search history.

(56) References Cited

U.S. PATENT DOCUMENTS 3,796,169 A * 3/1974 Bales ..... A47B 3/0815 248/188.8
5,749,121 A * 5/1998 Loescher ..... A47B 91/00 16/42 T
5,878,984 A * 3/1999 Grieser ..... A47B 91/00 248/688
6,149,113 A * 11/2000 Chen ..... A47B 91/00 248/188.9
6,883,763 B2 * 4/2005 Bosman ..... A47B 87/002 248/188.9
9,144,309 B2 * 9/2015 Adams ..... A47B 91/04
2003/0024447 A1 * 2/2003 Risdall ..... A47B 91/00 108/50.01

(Continued)

FOREIGN PATENT DOCUMENTS

CN 213215852 U 5/2021
CN 214594760 U 11/2021
JP 3235717 U * 1/2022 ..... A47B 91/005

*Primary Examiner* — Daniel J Rohrhoff
(74) *Attorney, Agent, or Firm* — Pearne & Gordon LLP

(57) ABSTRACT

An easily-assembled desk foot and a height-adjustable desk, the desk foot including: a desk foot body, which is internally hollow; an insertion opening at each end of the body and a connection hole on the desk foot body for connecting a lower end of a lifting column; and an end cover assembly at each end of the body, with insertion portions matched with the insertion openings of both ends of the body. The bottom of the insertion portion is connected with a support portion protruding downwardly and extending along a length direction of the insertion portion. The insertion portion and the support portion are integrally formed. When the insertion portion of the end cover assembly is inserted into the insertion opening, the support portion is supported at the bottom of the body. The height-adjustable desk according to the above technical solutions is simple and cost-saving to produce.

16 Claims, 4 Drawing Sheets

(56) References Cited

U.S. PATENT DOCUMENTS

| | | | | |
|---|---|---|---|---|
| 2007/0182222 | A1* | 8/2007 | Griepentrog | A47B 83/02 297/172 |
| 2017/0251802 | A1* | 9/2017 | Lu | A47B 13/06 |
| 2018/0184799 | A1* | 7/2018 | Lin | A47B 13/02 |
| 2021/0030146 | A1* | 2/2021 | Riebner | A47B 9/00 |

* cited by examiner

EASILY-ASSEMBLED DESK FOOT AND A HEIGHT-ADJUSTABLE DESK

TECHNICAL FIELD

The present invention relates to the technical field of office furniture, and in particular to an easily-assembled desk foot and a height-adjustable desk.

BACKGROUND

A height-adjustable desk is an office desk with its height adjustable. It is adjustable in height based on a body height, a sitting pose and a standing pose of a person and usually comprises an electric height-adjustable desk and a manual height-adjustable desk. The electric height-adjustable desk is adjusted in height by use of motor whereas the manual height-adjustable desk is adjusted in height by use of rotary handle or crank. In the prior arts, the height-adjustable desk structurally comprises a desk board, a desk board frame connected to the bottom of the desk board, a lifting column mounted at the bottom of the desk board frame and a desk foot mounted at a lower end of the lifting column. Further, a drive mechanism for driving the lifting column to lift is connected on the lifting column. In the prior arts, the desk foots of the height-adjustable desk are usually formed by cutting one length of section from a square metal pipe. For example, in the prior applications of the applicant with publication numbers CN214594760U and CN213215852U, a desk foot is disclosed, where a pipe plug for preventing deformation of an end face of the desk foot is connected respectively in inner holes at both ends of the desk foot, a downwardly-protruding foot pad is connected respectively at the bottoms of the two ends of the desk foot, and the foot pads are usually connected to the bottoms of both ends of the desk foot by bolts; during desk foot assembling, pipe plugs are firstly mounted into the inner holes at both ends of the desk foot and then foot pads are mounted at the bottoms of both ends of the desk foot; during production, the foot pad and the pipe plug are formed in two molds, resulting in complex production process, high production cost and troublesome assembling procedure.

SUMMARY

In order to overcome the defects of the prior arts, the present invention provides an easily-assembled desk foot which is simple in production process and cost-saving in production cost.

The technical solution of the present invention is to provide an easily-assembled desk foot with the following structure, which includes:

- a desk foot body, where the desk foot body is internally hollow, an insertion opening is disposed at both ends of the desk foot body respectively, and a connection hole for connecting a lower end of a lifting column is disposed on the desk foot body;
- two end cover assemblies, disposed at both ends of the desk foot body respectively, with insertion portions matched with the insertion openings of both ends of the desk foot body respectively; the bottom of the insertion portion is connected with a support portion protruding downwardly and extending along a length direction of the insertion portion, and the insertion portion and the support portion are integrally formed; when the insertion portion of the end cover assembly is inserted into the insertion opening, the support portion is supported at the bottom of the desk foot body.

Preferably, an insertion groove for inserting a bottom wall of the desk foot body is disposed between the insertion portion and the support portion, and the bottom wall of the desk foot body is inserted into the insertion groove to enable the top of the support portion and the bottom of the desk foot body to be mutually attached.

Preferably, a connection portion extending along the length direction of the insertion portion is disposed between the insertion portion and the support portion; two insertion grooves are formed by using two outer sidewalls of the connection portion, and the bottom wall of the insertion portion and a top wall of the support portion; an avoiding hole for inserting the connection portion when the insertion portion is inserted into the insertion opening is disposed on the bottom wall of the desk foot body.

Preferably, a plurality of outwardly-protruding strips distributed along a circumference of the insertion portion and extending along the length direction of the insertion portion are disposed on an outer sidewall of the insertion portion, and the outer sidewalls of the insertion ends of the protruding strips are disposed as outer-thin and inner-thick inclined surfaces.

Preferably, the insertion portion and the support portion are hollow structures with openings disposed at their inner ends.

Preferably, a radially-convex end cap is disposed at an outer end of the insertion portion; when the insertion portion is inserted into the insertion opening, an outer sidewall of the end cap is flushed with an outer sidewall of the desk foot body.

Preferably, the insertion portion and the support portion are a plastic integrally-injection-molded structure.

Preferably, the desk foot body is integrally formed by cutting a square metal pipe and both end surfaces of the desk foot body are vertical planes.

Compared with the prior arts, the easily-assembled desk foot having the above structure in the present invention has the following advantages: firstly, the insertion portion of the desk foot is equivalent to the pipe plug at both ends of the desk foot body, the support portion is equivalent to the foot pad at the bottom of the desk foot body, and the insertion portion and the support portion are integrally formed, that is, the end cover assembly formed by the insertion portion and the support portion is an integral structure. When the end cover assemblies are assembled, it is only required to insert the insertion portions into the respective insertion openings of both ends of the desk foot body. Therefore, the mounting process can be easily and conveniently completed without any hand tools. The integrally-formed end cover assembly has good structural stability. Further, when the insertion portion is inserted into the insertion opening, the support portion is supported at the bottom of the desk foot body, that is, the top of the support portion is closely attached to the bottom of the desk foot body. In this way, a contact area between the support portion and the desk foot body can be increased to achieve better support effect for the desk foot body and avoid occurrence of shake. Secondly, the connection portion is disposed between the insertion portion and the support portion and the avoiding hole for inserting the connection portion is disposed on the bottom wall of the desk foot body, such that the connection structure between the end cover assembly and the desk foot body becomes more stable and sturdier. In addition, the disposal of the avoiding hole and the disposal of the hollow structures of the insertion portion and the support portion can make the desk foot lighter and help move and mount it more easily and simply.

The other technical solution of the present invention is to provide a height-adjustable desk with the following structure: the height-adjustable desk comprises a desk board, a desk foot, a lifting column connecting the desk board and the desk foot, and a drive motor for driving the lifting column to lift. The desk foot is the desk foot according to any one of the above technical solutions.

Compared with the prior arts, the height-adjustable desk with the above structure according to the present invention has the following advantages: the connection operation between the end cover assembly of the desk foot of the height-adjustable desk and the desk foot body can be carried out easily and conveniently without any hand tools; the connection structure between the end cover assembly and the desk foot body is more stable and sturdier, and the desk foot can be manufactured in a simple process with lower costs.

Figure 1:
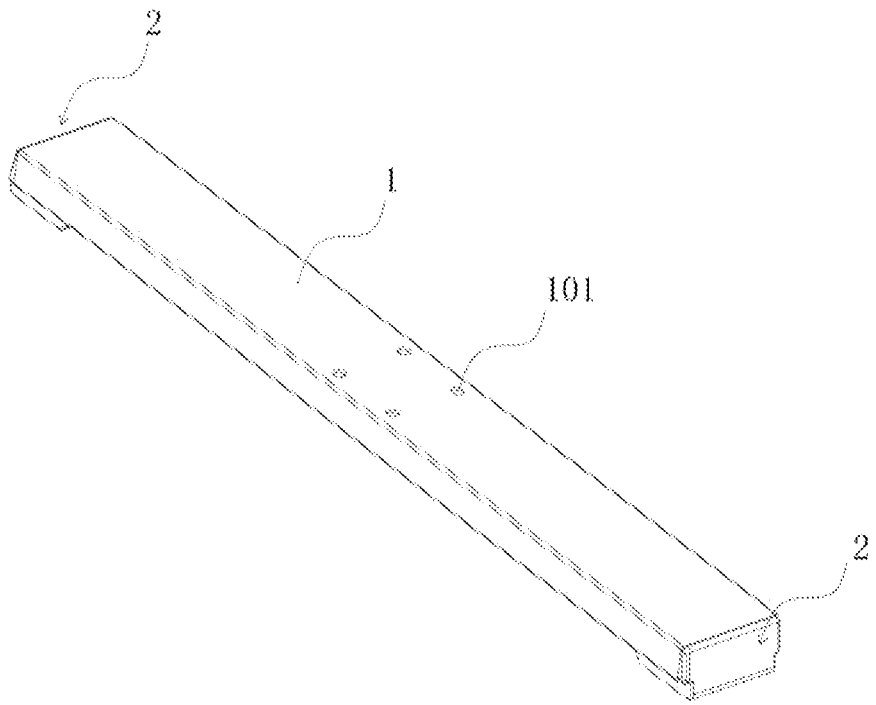
FIG. 1 is a structural schematic diagram of an easily-assembled desk foot according to an embodiment of the present invention.
Figure 2:
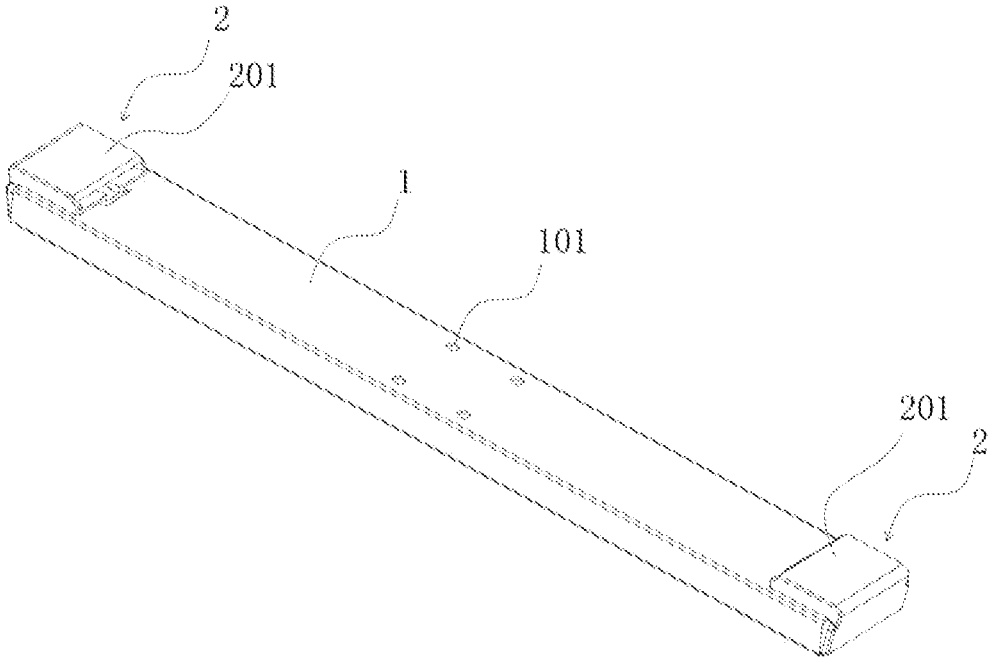
FIG. 2 is a schematic diagram of a bottom structure of an easily-assembled desk foot according to an embodiment of the present invention.
Figure 3:
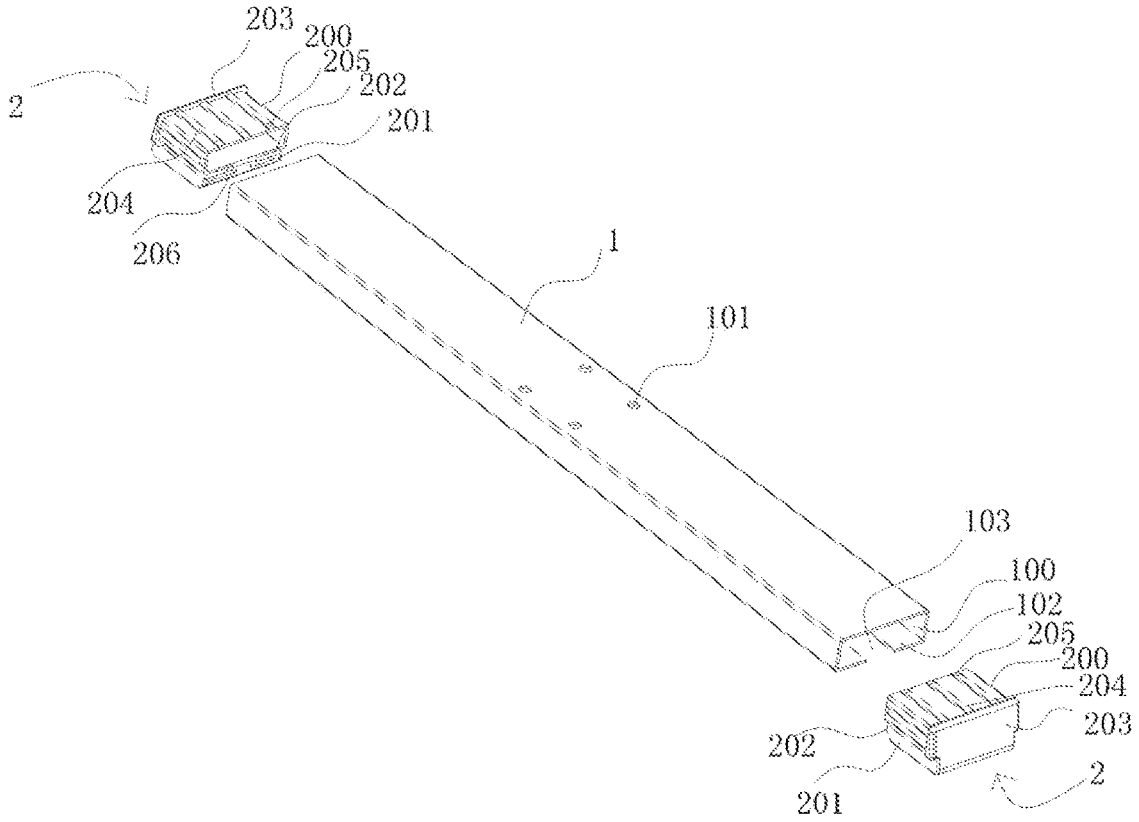
FIG. 3 is a schematic diagram of an assembling structure of an easily-assembled desk foot according to an embodiment of the present invention.
Figure 4:
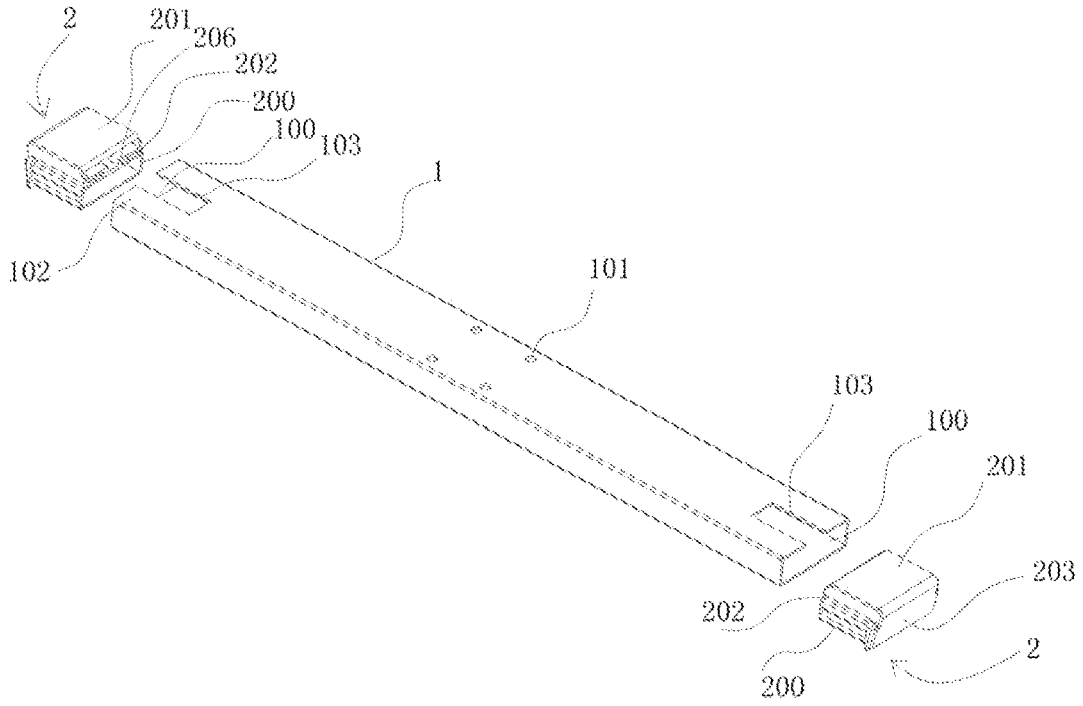
FIG. 4 is a schematic diagram of an assembling structure of another angle of an easily-assembled desk foot according to an embodiment of the present invention.
Figure 5:
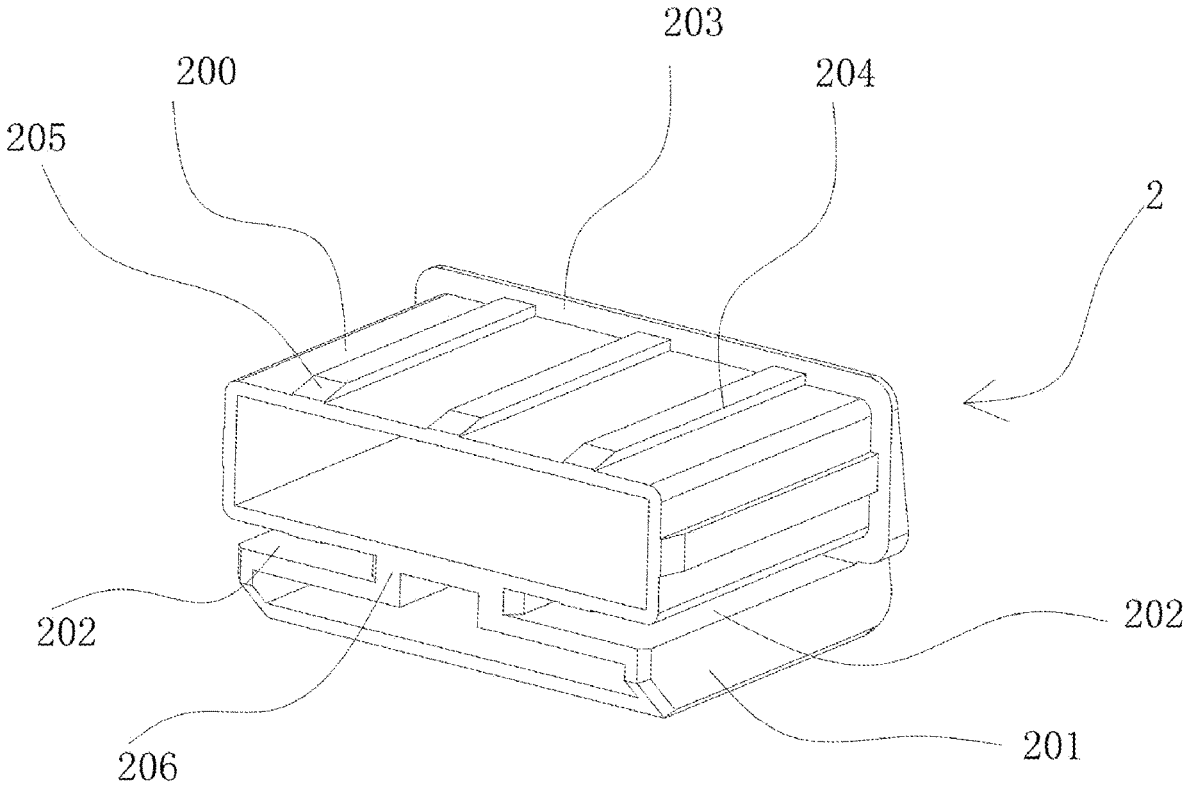
FIG. 5 is a structural schematic diagram of an end cover assembly of an easily-assembled desk foot according to an embodiment of the present invention.
Figure 6:
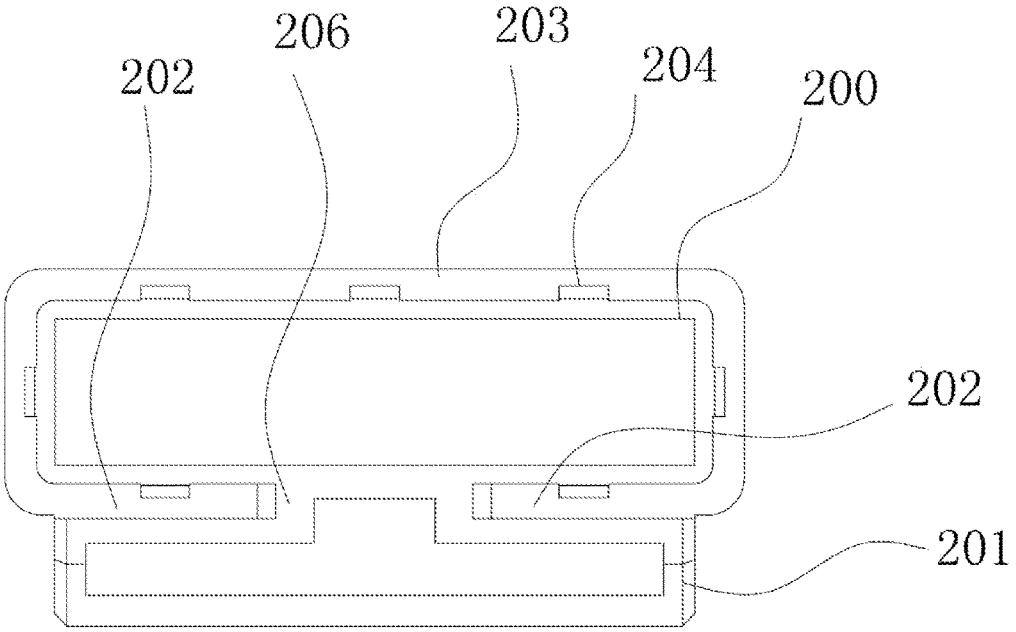
FIG. 6 is a schematic diagram illustrating an end surface of an end cover assembly of an easily-assembled desk foot according to an embodiment of the present invention.

Numerals of the drawings are described below: 1. desk foot body, 100. insertion opening, 101. connection hole, 102. bottom wall, 103. avoiding hole, 2. end cover assembly, 200. insertion portion, 201. support portion, 202. insertion groove, 203. end cap, 204. protruding strip, 205. inclined surface, 206. connection portion, 3. desk board, 4. lifting column.

EMBODIMENTS

The present invention will be further detailed below in combination with the accompanying drawings and the specific embodiments.

As shown in FIGS. 1 to 6, an embodiment of the present invention provides an easily-assembled desk foot, which is connected at a lower end of a lifting column of a height-adjustable desk or at a bottom of another office desk, shelf or display screen bracket to achieve a support effect as a base. In this embodiment, the desk foot structurally comprises a desk foot body 1, which is internally hollow and provided with insertion openings 100 at both ends. A connection hole 101 for connecting the lower end of the lifting column 4 is disposed on the desk foot body 1. The desk foot body 1 is formed integrally by cutting a square metal pipe, and both end surfaces of the desk foot body 1 are vertical planes. In other embodiments, the desk foot body 1 may also be formed by cutting a metal circular pipe, a metal polygonal pipe or a metal elliptical pipe or the like. Two end cover assemblies 2 are disposed at both ends of the desk foot body 1, and have insertion portions 200 matched with the insertion openings 100 at both ends of the desk foot body 1 respectively. The bottom of the insertion portion 200 is connected with a support portion 201 protruding downwardly and extending along a length direction of the insertion portion 200. When the insertion portion 200 of the end cover assembly 2 is inserted into the insertion opening 100, the support portion 201 is supported at the bottom of the desk foot body 1. In the present embodiment, the insertion portion 200 and the support portion 201 are integrally formed. Specifically, the insertion portion 200 and the support portion 201 are a plastic integrally-injection-molded structure, and the insertion portion 200 and the support portion 201 are hollow structures with openings disposed at their inner ends.

The insertion portion 200 of the desk foot is equivalent to the pipe plug at both ends of the desk foot body 1, the support portion 201 is equivalent to the foot pad at the bottom of the desk foot body 1, and the insertion portion 200 and the support portion 201 are integrally formed, that is, the end cover assembly 2 formed by the insertion portion 200 and the support portion 201 is an integral structure. The end cover assembly 2 can be processed in only one mold with simpler production procedure and lower production costs. Further, when the end cover assemblies 2 are assembled, it is only required to insert the insertion portions 200 into respective insertion openings 100 of both ends of the desk foot body 1. Therefore, the mounting process can be easily and conveniently completed without any hand tools or any fixing screws or the like. The integrally-formed end cover assembly 2 has good structural stability. Moreover, when the insertion portion 200 is inserted into the insertion opening 100, the support portion 201 is supported at the bottom of the desk foot body 1, that is, the top of the support portion 201 is closely attached to the bottom of the desk foot body 1. In this way, a contact area between the support portion 201 and the desk foot body 1 can be increased to achieve better support effect for the desk foot body 1 and avoid occurrence of shake.

By referring to the FIGS. 4 to 5 again, in an embodiment of the present invention, an insertion groove 202 for inserting a bottom wall 102 of the desk foot body 1 is disposed between the insertion portion 200 and the support portion 201, and the bottom wall 102 of the desk foot body 1 is inserted into the insertion groove 202 to enable the top of the support portion 201 and the bottom of the desk foot body 1 to be mutually attached. Specifically, a connection portion 206 extending along the length direction of the insertion portion 200 is disposed between the insertion portion 200 and the support portion 201, two insertion grooves 202 are formed by using two outer sidewalls of the connection portion 206, the bottom wall 102 of the insertion portion 200 and a top wall of the support portion 201, and an avoiding hole 103 for inserting the connection portion 206 when the insertion portion 200 is inserted into the insertion opening 100 is disposed on the bottom wall 102 of the desk foot body 1. The connection structure between the end cover assembly 2 and the desk foot body 1 is made more stable and sturdier. In addition, the disposals of the avoiding hole and the hollow structures of the insertion portion 200 and the support portion 201 can make the desk foot lighter and help move and mount it more easily and simply. In this embodiment, the insertion grooves 202 formed on the end cover assembly 2 are two insertion grooves symmetrical about the connection portion 206 left and right. In other embodiments, there may be one or three or more insertion grooves 202. In this embodiment, a radially-convex end cap 203 is disposed at an outer end of the insertion portion 200; when the insertion portion 200 is inserted into the insertion opening 100, an outer sidewall of the end cap 203 is flushed with an outer sidewall of the desk foot body 1. In this case, after the end cover assemblies 2 are inserted into the desk foot body 1, both ends of the desk foot body 1 will be smoother and more integral.

By referring to FIG. 5 again, in an embodiment of the present invention, a plurality of outwardly-protruding strips 204 distributed along a circumference of the insertion portion 200 and extending along the length direction of the insertion portion 200 are disposed on an outer sidewall of the insertion portion 200, and the outer sidewalls of the insertion ends of the protruding strips 204 are disposed as outer-thin and inner-thick inclined surfaces 205. The disposal of the protruding strips 204 increases the mechanical strength of the insertion portion 200, and the disposal of the inclined surface 205 of the insertion end of the protruding strip 204 facilitates insertion of the end cover assembly 2 into the insertion opening 100 of the desk foot body 1. In this embodiment, a cross section of the insertion portion 200 is quadrilateral and thus protruding strips 204 are distributed on the top, bottom, and two sides of the insertion portion 200. In other embodiments, the cross section of the insertion portion 200 may also be circular or elliptical or the like, and at this time, a plurality of protruding strips 204 may be distributed along the circumference of the outer sidewall of the insertion portion 200.

Figure 7:
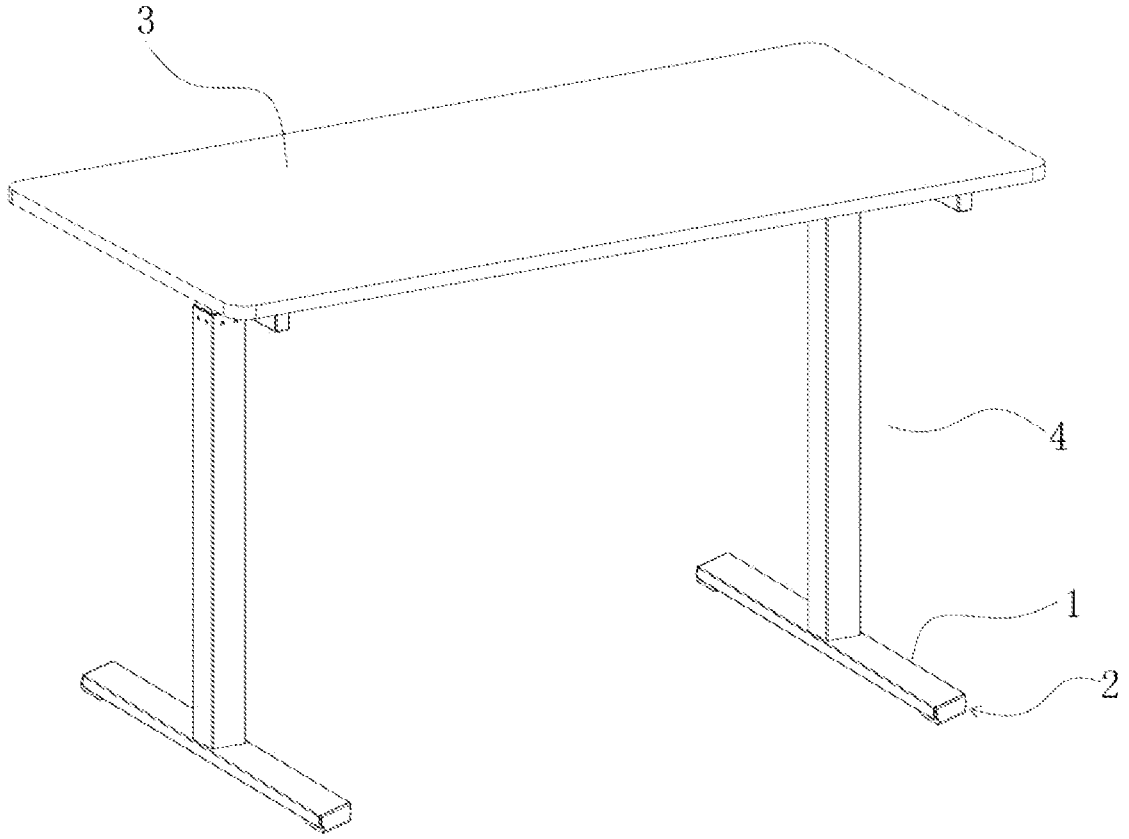
FIG. 7 is a structural schematic diagram illustrating a height-adjustable desk according to an embodiment of the present invention.

As shown in FIG. 7, another embodiment of the present invention provides a height-adjustable desk, which structurally comprises a desk board 3, a desk foot, a lifting column 4 connecting the desk board 3 and the desk foot, and a drive motor for driving the lifting column to lift. The desk foot of the height-adjustable desk may be the desk foot according to any one of the above embodiments. The connection operation between the end cover assembly 2 of the desk foot of the height-adjustable desk and the desk foot body 1 can be carried out easily and conveniently without any hand tools; the connection structure between the end cover assembly 2 and the desk foot body 1 is more stable and sturdier, and the desk foot can be manufactured in a simple process with lower costs.

The above descriptions are merely the specific embodiments of the present invention but the scope of protection of the present invention is not limited hereto. Any changes or substitutions easily thought of by those skilled in the art within the technical scope of the present invention shall fall within the scope of protection of the present invention. Therefore, the scope of protection of the present invention is indicated by the claims.

The invention claimed is:

1. An easily-assembled desk foot, wherein it comprises:

a desk foot body, and the desk foot body is internally hollow; an insertion opening is disposed at both ends of the desk foot body respectively, and a connection hole for connecting a lower end of a lifting column is disposed on the desk foot body;

two end cover assemblies, disposed at both ends of the desk foot body respectively, with insertion portions matched with the insertion openings of both ends of the desk foot body respectively; the bottom of the insertion portion is connected with a support portion protruding downwardly and extending along a length direction of the insertion portion, and the insertion portion and the support portion are integrally formed; when the insertion portion of the end cover assembly is inserted into the insertion opening, the support portion is supported at the bottom of the desk foot body, wherein a connection portion is disposed between the insertion portion and the support portion; an avoiding hole for inserting the connection portion when the insertion portion is inserted into the insertion opening is disposed on a bottom wall of the desk foot body.

2. The easily-assembled desk foot of claim 1, wherein an insertion groove for inserting the bottom wall of the desk foot body is disposed between the insertion portion and the support portion, and the bottom wall of the desk foot body is inserted into the insertion groove to enable the top of the support portion and the bottom of the desk foot body to be mutually attached.

3. The easily-assembled desk foot of claim 2, wherein the connection portion extends along the length direction of the insertion portion; two insertion grooves are formed by using two outer sidewalls of the connection portion, and the bottom wall of the insertion portion and a top wall of the support portion.

4. A height-adjustable desk, comprising a desk board, a desk foot, a lifting column connecting the desk board and the desk foot, and a drive motor for driving the lifting column to lift, wherein the desk foot is the desk foot of claim 3.

5. A height-adjustable desk, comprising a desk board, a desk foot, a lifting column connecting the desk board and the desk foot, and a drive motor for driving the lifting column to lift, wherein the desk foot is the desk foot of claim 2.

6. The easily-assembled desk foot of claim 1, wherein a plurality of outwardly-protruding strips distributed along a circumference of the insertion portion and extending along the length direction of the insertion portion are disposed on an outer sidewall of the insertion portion, and the outer sidewalls of the insertion ends of the protruding strips are disposed as outer-thin and inner-thick inclined surfaces.

7. A height-adjustable desk, comprising a desk board, a desk foot, a lifting column connecting the desk board and the desk foot, and a drive motor for driving the lifting column to lift, wherein the desk foot is the desk foot of claim 6.

8. The easily-assembled desk foot of claim 1, wherein the insertion portion and the support portion are hollow structures with openings disposed at their inner ends.

9. A height-adjustable desk, comprising a desk board, a desk foot, a lifting column connecting the desk board and the desk foot, and a drive motor for driving the lifting column to lift, wherein the desk foot is the desk foot of claim 8.

10. The easily-assembled desk foot of claim 1, wherein a radially-convex end cap is disposed at an outer end of the insertion portion; when the insertion portion is inserted into the insertion opening, an outer sidewall of the end cap is flushed with an outer sidewall of the desk foot body.

11. A height-adjustable desk, comprising a desk board, a desk foot, a lifting column connecting the desk board and the desk foot, and a drive motor for driving the lifting column to lift, wherein the desk foot is the desk foot of claim 10.

12. The easily-assembled desk foot of claim 1, wherein the insertion portion and the support portion are a plastic integrally-injection-molded structure.

13. A height-adjustable desk, comprising a desk board, a desk foot, a lifting column connecting the desk board and the desk foot, and a drive motor for driving the lifting column to lift, wherein the desk foot is the desk foot of claim 12.

14. The easily-assembled desk foot of claim 1, wherein the desk foot body is integrally formed by cutting a square metal pipe and both end surfaces of the desk foot body are vertical planes.

15. A height-adjustable desk, comprising a desk board, a desk foot, a lifting column connecting the desk board and the desk foot, and a drive motor for driving the lifting column to lift, wherein the desk foot is the desk foot of claim 14.

16. A height-adjustable desk, comprising a desk board, a desk foot, a lifting column connecting the desk board and the desk foot, and a drive motor for driving the lifting column to lift, wherein the desk foot is the desk foot of claim 1.

* * * * *